United States Patent [19]

Yang et al.

[11] Patent Number: 4,919,732

[45] Date of Patent: Apr. 24, 1990

[54] IRON-NEODYMIUM-BORON PERMANENT MAGNET ALLOYS WHICH CONTAIN DISPERSED PHASES AND HAVE BEEN PREPARED USING A RAPID SOLIDIFICATION PROCESS

[75] Inventors: Choong-Jin Yang, Lowell; Ranjan Ray, Andover, both of Mass.

[73] Assignee: Kubota Ltd., Osaka, Japan

[21] Appl. No.: 223,624

[22] Filed: Jul. 25, 1988

[51] Int. Cl.[5] ..... H01F 1/02

[52] U.S. Cl. ..... 148/103; 148/101; 148/104; 164/463; 419/12

[58] Field of Search ..... 148/302, 101, 102, 103, 148/104; 420/83, 121; 419/12, 31, 33, 38; 164/463, 477

[56] References Cited

U.S. PATENT DOCUMENTS 4,792,367 12/1988 Lee ..... 148/104

FOREIGN PATENT DOCUMENTS 0133758 3/1985 European Pat. Off. ..... 148/302
62-291903 12/1987 Japan ..... 148/101
63-115307 5/1988 Japan ..... 148/102

*Primary Examiner*—John P. Sheehan
*Attorney, Agent, or Firm*—Armstrong, Nikaido, Marmelstein, Kubovcik & Murray

[57] ABSTRACT

New Iron-Neodymium-Boron base alloys containing hafnium diboride, zirconium diboride and titanium diboride are disclosed. The alloys are subjected to rapid solidification processing technique which produces cooling rates between $10^5$ to $10^7$ °C.second. The as-quenched filament, ribbon or particulate, powder etc. consists predominantly of a single amorphous phase. The amorphous powder is heat treated above the crystallization temperature into microcrystalline powder which is subsequently ground into ultrafine particles with average size less than 5 microns by attritor or hammer mill. The ultrafine powder particles are simultaneously aligned and cold compacted by the combined action of an applied magnetic field and uniaxial pressure. The green compacts containing particles with mostly aligned grains with their easy magnetization axes parallel to the applied field direction are sintered into bulk forms. The bulk alloy consists of ultrafine grained homogeneous crystalline phase with a large number of aligned magnetic domains. The ultrafine grained structure of the bulk alloy is dispersed with ultrafine particles of hafnium diboride, zirconium diboride or titanium diboride; the bulk alloy shows superior hard magnetic properties including improved coercivity and superior energy product values suitable for many engineering applications at room and elevated temperatures.

2 Claims, No Drawings

IRON-NEODYMIUM-BORON PERMANENT MAGNET ALLOYS WHICH CONTAIN DISPERSED PHASES AND HAVE BEEN PREPARED USING A RAPID SOLIDIFICATION PROCESS

BACKGROUND OF INVENTION

1. Field of the Invention

This invention relates to rapidly solidified ultrafine iron-neodymium-boron alloys obtained by adding small amounts of transition metal borides. This invention also relates to the preparation of these materials in the form of rapidly solidified filaments and particulates which are suitably heat treated and then communited into fine powders. The fine powders are aligned inside an applied magnetic field followed by pressing and sintering into near fully dense magnets possessing high energy products.

2. Description of the Prior Art

Permanent magnet materials are distinguished by microstructures including two magnetically different phases on an extremely fine scale, as in the Alnicos and Fe—Cr—Co alloys, high magnetocrystalline anisotropy, as in Co—Sm and the barium ferrites, or both, as in the Cu-modified cobalt-rare-earths and their descendants. These microstructures result from various processing and heat treatment procedures. Such structures can also be produced by crystallizing amorphous alloys or directly by rapid quenching. These processes lead to fine-scale heterogeneity and can also result in the production of phases, for example, $Fe_3B$, (see J. J. Rhyne, J. H. Schelleng and N. D. Koon in Physical Review. B10, pp. 4672, 1974) that would not be stable under more nearly equilibrium conditions. Such phases may have low symmetry and possibly high magnetocrystalline anisotropy. For all these reasons crystallized amorphous materials seemed attractive to explore for potential permanent magnet properties.

The high coercive forces and energy products $(BH)_{max}$ among commercial permanent magnet materials are found in cobalt-samarium alloys. The high coercivity results from the very high magnetocrystalline anisotropy that can occur in intermetallic compounds containing transition metals and rare earths. In search of new cobalt and samarium-free permanent magnet materials, the early studies (see R. C. Taylor in J. Appl. Physics, 47, pp. 1164, 1976) have been made on amorphous $RFe_2$ (R=rare earth) prepared by rapid quenching having large coercivities at cryogenic temperatures. Since then similar behavior has been observed in other rare earth systems (see A. E. Clark in Appl. Physics Letter, 23, pp. 642, 1973 and J. J. Croat in Appl. Physics Letter, 37, pp. 1096, 1980). The philosophy of the technical approach is to utilize the wide range of metastable microstructures accessible by rapid quenching at controlled rates followed (if desired) by heat treatment. The hard magnetic properties of these amorphous materials have been observed to increase with crystallization and Clark obtained a coercive field of 3.4 kOe and an energy product of 9 MGOe in $TbFe_2$ at room temperature. More recently Koon et al (see N. C. Koon and B. N. Das, Appl. Physics Letter, 39, pp. 840, 1981) have observed high coercive fields in $(Fe_{80}B_{20})_{90}La_5Tb_5$ alloys crystallized from amorphous state. Continuing this effort Croat (see J. J. Croat, in J. Appl. Physics, 53, pp. 3161, 1982) produced high coercive fields in rapidly solidified ribbons of $R_{40}FE_{60}$ alloys. Hadjipanayis et al (see G. C. Hadjipanyis, R. C. Hazelton, and K. R. Lawless, J. Appl. Phys. 55, pp 2073, 1984) investigated magnetic properties of rapidly quenched ribbons of FeRM alloys where R=La,Y,Pr,Nd,Gd and M-B,Si,Al,Ga,Ge over a wide range of chemical compositions. The alloys are generally magnetically soft in as-quenched amorphous state. Magnetic hardening is produced by crystallizing the amorphous phase by heat treatment at 700° C. The best properties have been obtained in alloys based on iron-neodymium-boron (Fe—Nd—B) and iron-praseodymium-boron (Fe—Pr—B) systems. The hard magnetic properties of these materials are attributed to a highly anisotropic phase. X-ray diffraction and transmission electron microscopy (TEM) indicate that the high energy product alloys in the R—Fe—B systems crystallized from amorphous state consist of an extremely fine grained equilibrium phase. This phase is $R_2Fe_{14}B$ according to Croat et al (see J. J. Croat, J. F. Herbst, R. W. Lee and F. E. Pinkerton, in 29th Annual Conf. on Magnetism and Magnetic Materials, Pittsburgh, PA, November, 1983). Other researchers have identified the stoichiometry of this phase to be $R_3Fe_{16}B$, $R_3Fe_{20}B$, or $R_3Fe_{21}B$ (see G. C. Hadjipanyis, R. C. Hazelton and K. Lawless, J. Appl. Phys. Lett. 43, pp. 797, 1983). The hard magnetic phase has a tetragonal crystal structure with lattice constants a=8.8A and c=12.2A. The Curie temperature of this phase is 600 K.°. The transmission electron microscopy results showed that the particles composing the magnetically hard samples in R—Fe—B alloys are roughly spherical with diameter ranging from 20 to 100 nm. Croat et al (see J. J. Croat et al in 29th Annual Conference on Magnetism and Magnetic Materials, Pittsburgh, PA, November 1983) estimated a range of 80–100 nm for the single domain particle diameter using the observed Curie temperature and estimates of the exchange and anisotropy energies. The high coercivity mechanism is attributed to the effects due to the single domain particle. Limited studies of the effect of heat treatment variables have shown that the magnetic hardness to be a sensitive property of the anneal temperature. With increasing heat treatment temperature, the particle size of the hard magnetic phase in the crystallized alloy increases, leading to decrease in the coercivity due to multidomain effects.

Although promising permanent magnet alloy compositions have been identified in the light rare earth-iron-boron systems which can be prepared into bulk magnets from powders by various powder metallurgy processing techniques producing energy product values at room temperature ranging between 10 to 35 MGOe (see M. Sagawa, S. Fijimura, N. Togawa, H. Yamamoto and Y. Matsuura, J. Appl. Phys. 55, pp. 2083, 1984), these magnets suffer from certain drawbacks. They possess low Curie temperature ($T_c$), and exhibit rapid decrease in coercivity ($H_c$) and magnetization moment with increasing temperature. The poor thermal stability of iron-rare earth-boron magnets have prevented their widespread commercial use. In order to increase the application temperatures or in other words, the thermal stability of the Fe—Nd—B magnets, $H_c$ and/or $T_c$ of the alloys must be enhanced by one way or the other. Substitution of iron by cobalt results in increasing Curie temperature with a decreased coercivity (see M. Sagawa, S. Fujimura, H. Yamamoto, Y. Matsuura and K. Hiraga in IEEE Trans. Magn. *MAG*.20 pp. 1584, 1984). Heavy rare earths such as dysprosium or terbium increases coercivity but reduces remanent magnetization (see Y. Yang, W. James, X. Li and H. Chen in IEEE Trans. Magn. *MAG*.22, pp. 757, 1986). Partial substitution of iron with aluminum has been found to increase coercivity while reducing remanent induction and Curie temperature (see Z. Maocai, M. Deging, J. Xiuling and L. Shigiang in Proc. 8th International Workshop on REPM, Dayton, OH, pp. 554, 1985). Most efforts in the prior art so far have failed to enhance the thermal stability of Fe—Nd—B band permanent magnets. Therefore, there is a need to develop new processing methods to fabricate Fe—Nd—B alloys modified with suitable alloying elements which lead to desirable structures and magnetic properties of such alloys with enhanced thermal stability.

SUMMARY OF THE INVENTION

This invention features a class of iron-neodymium-boron base permanent magnet alloys having high energy product values and high coercivity when the production of these alloys includes a rapid solidification process, heat treatment and powder milling process and a powder consolidation process based on magnetic alignment of powders followed by pressing and sintering to fully dense parts.

These alloys can be described by the following compositions:

$Fe_aCo_bNd_cR_dN_eB_f$ containing 0.3 to 3 weight percent of $MB_2$.

Wherein, Fe, Co, Nd and B are iron, cobalt, neodymium and boron, respectively. R is one element from the group consisting of praseodymium (Pr), lanthanum (La), yttrium (Y), cerium (Ce), dysprosium (Dy), gadolinium (Gd), terbium (Tb) and mixtures thereof, and N is at least one element from the group consisting of aluminum (Al), silicon (Si), germanium (Ge), Niobium (Nb) and gallium (Ga) and mixtures thereof, and M is at least one element from the group consisting of hafnium (Hf), zirconium (Zr), tantalum (Ta) and titanium (Ti) and mixtures thereof, and wherein a,b,c,d,e and f represent the ranges of atom percent having the values a=60 to 80, b=0 to 20, c=10 to 20, d=0 to 10, e=0 to 5 and f=3 to 10, respectively, with the provisos that the sum (a+b+c+d+e+f) must be 100.

Preferably, neodymium is present in an amount of about 12 to 16 atom percent and boron is present in an amount about 7 to 10 atom percent of the total alloy composition and also, preferably hafnium diboride ($H_fB_2$), titanium diboride ($TiB_2$), tantalum diboride ($TaB_2$) or zirconium diboride ($ZrB_2$) is present singly or combined in the range from 1 to 2 weight percent to attain superior permanent magnet properties, good structural integrity and homogeneous microstructure.

Rapid solidification processing (RSP) (i.e. processing in which the liquid alloy is subjected to cooling rates of the order of $10^{5°}$ and $10^{7°}$ C./sec.) of such alloys produces predominantly a metallic glass (i.e. amorphous) structure which is chemically homogeneous and can be heat treated and/or thermomechanically processed so as to form microcrystalline alloy with fine grain structure containing an ultrafine dispersion of transition metal diboride particles. The alloy is prepared as rapidly solidified filament, ribbon or particulate by melt spinning techniques. The as quenched ribbon or filament is brittle and is readily communited to powder using standard pulverization techniques e.g. rotating hammer mill to particle size less than 60 mesh (U.S. Standard). The amorphous powder is crystallized by annealing heat treatment above the crystallization temperature under vacuum or inert atmosphere. The crystallization treatment is carried out at 600°-800° C. preferably at 700° C. for 1-2 hours. The heat treated powders are subsequently ground to very small particle size of less than 5 microns by a standard high energy attritor or a rotating hammer mill under inert atmosphere. The ultrafine crystalline powders are cold compacted under an applied magnetic field. The major part of the crystalline powders become oriented so as to allow a large fraction of magnetic domains to be aligned parallel to the direction of the applied magnetic field. The magnetically aligned powder compact is sintered in vacuum or in argon atmosphere at 1000°-1200° C. for 1-2 hours followed by cooling to room temperature. The preferred sintering temperature is 1100° C. for 1.5 hours. The final consolidated products exhibit good permanent magnet properties such as high room temperature coercivity and excellent thermal stability of coercivity and magnetization moment.

DETAILED DESCRIPTION OF THE INVENTION

In accordance with the present invention, iron base transition metal alloys, iron base transition metal alloys containing 5 to 20 atom percent neodymium and 3 to 10 atomic percent of boron are alloyed with the following constituents: 0-20 atomic percent of Co, 0-10 atomic percent of La,Y,Ce,Dy,Tb,Gd and Pr either singly or combined, 0 to 5 atomic percent of Al,Si,Ge,Nb and Ga either singly or combined and 0.3 to 3 weight percent of either hafnium diboride, zirconium diboride, tantalum diboride or titanium diboride. The alloys may also contain limited amounts of other elements which are commercially found in iron base alloys without changing the essential behavior of the alloys. Typical examples include ($Fe_{78}Nd_{16}B_6$+1% $H_fB_2$), ($Fe_{78}Nd_{16}B_6$+1% $ZrB_2$), ($Fe_{78}Nd_{16}B_6$+1% $TiB_2$), ($Fe_{68}Co_{10}Nd_{1.3}Dy_3B_6$+0.8% $ZrB_2$), ($Fe_{66}Co_8Nd_{12}Pr_2Dy_2B_8$+1.4% $TiB_2$), ($Fe_{70}Co_9Nd_{14}Dy_4Al_1Si_2Ga_1B_2$+0.5% $H_fB_2$), ($Fe_{70}Co_8Nd_{12}Y_1Pr_2Ge_1B_6$+2% $ZrB_2$) and ($Fe_{73}Co_3Nd_{13}Pr_2Dy_1B_8$+1% $TaB_2$).

The alloys of the present invention upon rapid solidification processing the melt by melt spinning chill casting process at cooling rates of the order of $10^{5°}$ to $10^{7°}$ C./second form ribbons, filaments or powders with average particle size less than 60 mesh (U.S. Standard) consisting predominantly of metallic glass (i.e. amorphous structure) with high degree of compositional uniformity. The melt spun ribbons or filaments are readily pulverized into powders having particle size less than 60 mesh comprising platelets having and average thickness less than 100 micrometer and each platelet being characterized by an irregularly shaped outline resulting from fracture thereof.

The pulverized −60 mesh (U.S. Standard) amorphous powders are crystallized by heat treatment at 600°-800° C. The crystallized powders are ground in a high energy attritor into ultrafine particles with average size of 5 microns or less. The ultrafine powders contained in a suitable mold or die are magnetically aligned and cold compacted under simulatneous application of an applied magnetic field with field strength of 16-19 kOe and uniaxial or isostatic pressure between 30 to 50 Ksi. The aligned green compacts are sintered at 1000°-1200° C. for 1-2 hours.

The melt spinning method referred to herein includes any of the processes such as single roll chill block casting, double roll quenching, melt extraction, melt drag, etc., where a thin layer of molten metal or alloy is brought in contact with a chill solid substrate moving at a high speed.

The properties of permanent magnet are determined by its remanent magnetization i.e. remanence and extrinsic coercivity. With increase in the values of the remanence and extrinsic coercivity, the energy product value of the permanent magnet is enhanced.

In accordance with the present invention, improved magnets are prepared via enhancement of extrinsic coercivity and remanence which are obtained via control of alloying additions, modification of microstructure and rapid solidification powder metallurgical processing techniques.

A small amount of metal borides based on either Hf, Ti, Ta or Zr additions in the concentration range from 0.3 to 3 weight percent to the present alloys was found to be critical to achieve the most desirable properties in the bulk magnets made from such alloys. The metal element and boron are retained in solution in the rapidly solidified amorphous phase. During subsequent heat treatment, the amorphous phase is recrystallized into aggregate of microcrystalline phases. The metal element and boron preferably form ultrafine particles of metal diboride ($MB_2$) which predominantly act to stabilize the fine grains of iron-neodymium-boron magnetic phase ($Fe_{14}Nd_2B$). During hot consolidation of rapidly solidified powders, the ultrafine dispersion of the $MB_2$ phase prevents the fine iron-neodymium-boron grains from coarsening.

At $MB_2$ contents below 0.3 wt%, the volume fraction of $MB_2$ dispersoids in the alloy is too little to cause effective grain refinement of the alloys. When $MB_2$ contents in the alloy exceeds 3 wt%, the excessive amount of dispersoids is formed. The consolidated magnets are very brittle due to excessive amounts of metal boride phase exhibiting undesirable mechanical properties as well as decreased magnetization moment.

The microcrystalline iron-neodymium-boron magnet alloys prepared via magnetic alignment of ultrafine powders followed by cold compaction and sintering at 1000°-1200° C., have matrix grain size of less than 5 microns, preferably less than 2 microns randomly interspersed with particles of metal boride having a particle size measured in its largest dimension of less than 0.5 micron, preferably less than 0.2 micron and said metal diboride particles being located at grain boundaries and within the grains as well.

The iron-neodymium-boron alloys without metal diboride contents when consolidated in the temperature range from 1000° to 1200° C. exhibit relatively large grains of the order of 15 to 20 microns.

The effect of fine grains is to increase the coercivities (intrinsic and extrinsic) of the magnets. The magnetic domains generally nucleate at heterogeneous sites such as grain boundaries. The domains nucleated at grain boundaries become pinned by fine dispersoids of metal diboride and the motion of domain wall necessary for the growth of the domains becomes more difficult and require higher magnetizing force.

The method of magnetic alignment of ultrafine crystalline powders followed by compaction and sintering at elevated temperatures to bulk magnets of the present invention was found to be beneficial to cause improvement in the magnetic properties via enhancement of coercivity. When the rapidly solidified amorphous powders are crystallized at 600°-1000° C. the crystallization of iron-neodymium-boron base phase ($Fe_{14}Nd_2B$) having a long tetragonal crystal structure takes place. The individual grains remain very fine as their growth is inhibited by formation of ultrafine metal diboride dispersoids at the grain boundaries. During subsequent milling operation using an attritor, the crystallized coarse powders are ground to ultrafine powders having an average size less than 5 microns and preferably between 2 to 3 microns. Each fine particle is reduced almost to the size of one to two grains. The ultrafine crystalline powders in a mold when subjected to an external applied magnetic field undergo preferred orientation. A predominant percentage of these $Fe_{14}Nd_2B$ crystals become oriented with their c-axes parallel to the direction of the applied magnetic field. The c-axis of the iron-neodymium-boron magnet phase ($Fe_{14}Nd_2B$) is also the direction along which the magnetization of the tetragonal crystalline phase can be easily accomplished, and hence alignment of many crystals with their c-axes oriented parallel to the direction of the applied magnetic field enhances the overall magnetization moments of the sintered magnet.

The sintered magnets made from ultrafine crystalline powders are aged at 650°-750° C. for 1 hour followed by fast cooling to room temperature. During sintering some neodymium rich phase having the composition $Nd_{17}Fe_3$ is formed as revealed by Scanning Electron Microscopy at the boundaries between the primary grains of the hard magnetic phase based on $Fe_{14}Nd_2B$. The aging treatment modifies the morphology of the $Nd_{17}Fe_3$ phase from discontinuous particles to continuous film and improves the extrinsic coercivity of the consolidated magnets.

EXAMPLES 1 TO 20

Selected Fe—Nd—B base alloys containing 0-20 atom percent of Co, 0-10 atom percent of La, Y, Ce, Dy, Gd, Tb and Pr either singly or combined, 0 to 5 atom percent of Al, Si, Ge, Nb and Ga either singly or combined are alloyed with 0.3 to 3 weight percent of metal diborides such as hafnium diboride ($HfB_2$), zirconium diboride ($ZrB_2$), tantalum diboride ($TaB_2$) and titanium diboride ($TiB_2$9 either singly or combined. The metal diboride containing alloys are melt spun into filaments, 10 to 50 microns thick and 400 to 500 microns wide by the rapid solidification technique of melt spinning using a rotating copper-beryllium cylinder having a quench surface speed of 40 m/sec. The filaments are found by X-ray diffraction analysis to consist predominantly of an amorphous phase. The compositions of the alloys are listed in Table 1.

TABLE 1

| Example | Alloy Composition | Structure of melt Spun Filaments by X-ray Diffraction |
|---|---|---|
| 1 | $Fe_{78}Nd_{16}B_6$ + 1% $HfB_2$ | amorphous |
| 2 | $Fe_{68}Co_{10}Nd_{10}Dy_6B_6$ + 0.5% $HfB_2$ | amorphous |
| 3 | $Fe_{66}Co_8Nd_{12}Pr_2Dy_2Al_1B_8$ + 0.3% $HfB_2$ | amorphous |
| 4 | $Fe_{66}Co_8Nd_{12}Pr_2Dy_2Al_2B_8$ + 1.4% $HfB_2$ | amorphous |

TABLE 1-continued

| Example | Alloy Composition | Structure of melt Spun Filaments by X-ray Diffraction |
|---|---|---|
| 5 | $Fe_{74}Co_4Nd_{12}Y_1Pr_1Ge_2B_6$ + 2% $H_fB_2$ | amorphous |
| 6 | $Fe_{70}Co_8Nd_{16}Si_1B_5$ + 3% $H_fB_2$ | amorphous |
| 7 | $Fe_{68}Co_{12}Nd_{12}Al_2B_6$ + 1.5% $H_fB_2$ | amorphous |
| 8 | $Fe_{67}Co_{10}Nd_{13}Ga_2Al_1SiB_6$ + 1.2% $H_fB_2$ | amorphous |
| 9 | $Fe_{67}Co_{10}Dy3Nd_{10}Ge_1Si_2B_7$ + 0.8% $H_fB_2$ | amorphous |
| 10 | $Fe_{78}Nd_8Ce_2Tb_2Y_2B_8$ + 1.2% $H_fB_2$ | amorphous |
| 11 | $Fe_{78}Nd_{16}B_6$ + 1.5% $ZrB_2$ | amorphous |
| 12 | $Fe_{67}Co_{10}Nd_{16}B_7$ + 1.0% $ZrB_2$ | amorphous |
| 13 | $Fe_{70}Co_8Nd_{15}B_7$ + 0.7% $ZrB_2$ | amorphous |
| 14 | $Fe_{72}Co_4Nd_{10}Pr_2Dy_1Al_3B_8$ + 1.5% $ZrB_2$ | amorphous |
| 15 | $Fe_{15}Co_{10}Nd_{13}Ga_2Tb_1Ce_1Si_1B_7$ + 2% $ZrB_2$ | amorphous |
| 16 | $Fe_{78}Nd_{15}B_6Nb_1$ + 1% $TiB_2$ | amorphous |
| 17 | $Fe_{68}Co_{10}Nd_{15}B_6Nb_1$ + 1.5% $TiB_2$ | amorphous |
| 18 | $Fe_{72}Nd_{14}Ce_2Tb_1Dy_1Y_2B_8$ + 0.5% $TiB_2$ | amorphous |
| 19 | $Fe_{67}Co_{10}Dy_3Nd_{12}Si_1B_7$ + 2% $TaB_2$ | amorphous |
| 20 | $Fe_{70}Co_8Nd_{16}Si_1B_5$ + 2% $TaB_2$ | amorphous |

EXAMPLES 21 TO 29

The alloys listed in Table 2 are prepared from constituent elements of high purity (≧99.9%) by the arc melting technique under argon atmosphere. The alloys are subsequently melt spun into filaments consisting predominantly of a single amorphous phase. The filaments are pulverized into powder with average particle size less than 60 mesh (U.S. Standard). The −60 mesh powders are heat treated (i.e. crystallized) at 750° C. for 1 hour. Approximately, one pound pulverized powders (crystallized) of each alloy are ground in a high energy attritor under argon atmosphere into fine powder with average particle size of 3 microns. The fine powders are magnetically aligned in an applied magnetic field with 16–19 kOe field strength while being cold compacted in a non-magnetic stainless steel die under uniaxial pressure of 35–50 ksi. The magnetically anisotropic compacts are sintered in vacuum at 1000°–1200° C. for 1–2 hours followed by fast cooling to room temperature.

TABLE 2

| Example | Composition | Compaction Pressure KSI | Applied Field Strength For Magnetic Alignment (KGOe) | Sintering Parameters Time Hour | Sintering Parameters Temp (C.) |
|---|---|---|---|---|---|
| 21 | $Fe_{78}Nd_{16}B_6$ + 1% $H_fB_2$ | 40 | 16 | 1 | 1080 |
| 22 | $Fe_{77}Nd_{16}B_7$ + 1.5% $ZrB_2$ | 45 | 19 | 1.5 | 1100 |
| 23 | $Fe_{68}Co_{10}Nd_{13}Dy_3B_6$ + 0.8% $TiB_2$ | 40 | 19 | 1.5 | 1080 |
| 24 | $Fe_{66}Co_8Nd_{12}Pr_4Dy_2Al_2B_4$ + 1.2% $ZrB_2$ | 50 | 19 | 2 | 1100 |
| 25 | $Fe_{67}Co_{10}Nd_{16}B_7$ + 1.0% $ZrB_2$ | 45 | 19 | 1.5 | 1080 |
| 26 | $Fe_{67}Co_{10}Dy_3Nd_{12}Si_1B_7$ + 1.2 $TiB_2$ | 40 | 19 | 2 | 1080 |
| 27 | $Fe_{70}Co_8Nd_{16}Si_1B_5$ + 2% $TiB_2$ | 35 | 16 | 2 | 1050 |
| 28 | $Fe_{78}Nd_{12}Ce_2Tb_1Y_1B_6$ + 1.2% $H_fB_2$ | 40 | 16 | 1.5 | 1100 |
| 29 | $Fe_{73}Nd_{12}Co_6Tb_2Dy_1B_6$ + 1% $TaB_2$ | 40 | 19 | 2 | 1100 |

EXAMPLES 30 TO 41

Table 3 lists twelve alloys prepared from constituent elements of high purity (≧99.9%) by the arc melting technique under argon atmosphere. Six of the twelve alloys are made with additions of metal diborides e.g. $H_fB_2$, $ZrB_2$ or $TiB_2$ and the remaining six alloys are made with identical compositions devoid of any metal diborides.

The alloys are subsequently melt spun into filaments consisting predominantly of a single amorphous phase. The filaments are pulverized into powders with average particle size less than 60 mesh (U.S. Standard) followed by heat treatment at 800° C. for 2 hours. Approximately, one pound pulverized and heat treated powders of each alloy are ground in a high energy attritor under argon atmosphere into fine powders with average size of 3 microns. The fine powders are magnetically aligned in an applied magnetic field with 19 kOe field strength while being cold compacted in a non-magnetic stainless steel die under uniaxial pressure of 40 ksi. The magnetically aligned powder compacts are sintered at 1100° C. for 1 hour followed by fast furnace cooling to room temperature. The sintered magnets are characterized for Curie temperature ($T_c$). The intrinsic coercivities of the sintered magnets are measured at room temperature, 150° C. and 250° C., respectively. The coercivities of sintered magnets containing fine dispersion of metal diborides are found to be consistently higher than the magnets devoid of dispersions.

TABLE 3

| Example | Composition | Curie Temp. (°C.) | Intrinsic Coercivity (kOe) Room | 150 C. | 200 C. |
|---|---|---|---|---|---|
| 30 | $Fe_{78}Nd_{16}B_6$ | 320 | 12 | 4.0 | 2.0 |
| 31 | $Fe_{78}Nd_{16}B_6$ + 1% $H_fB_2$ | 320 | 15 | 5.0 | 3.3 |

TABLE 3-continued

| Example | Composition | Curie Temp. (°C.) | Intrinsic Coercivity (kOe) Room | 150 C. | 200 C. |
|---|---|---|---|---|---|
| 32 | $Fe_{80}Nd_{12}B_8$ | 320 | 12 | 4.0 | 2.0 |
| 33 | $Fe_{80}Nd_{12}B_8$ + 1.5% $ZrB_2$ | 320 | 16 | 6.0 | 4.0 |
| 34 | $Fe_{68}Co_{10}Nd_{13}Dy_3B_6$ | 410 | 17 | 6.0 | 3.0 |
| 35 | $Fe_{68}Co_{10}Nd_{13}Dy_3B_6$ + 0.8% $TiB_2$ | 410 | 22 | 6.3 | 3.5 |
| 36 | $Fe_{66}Co_6Nd_{12}Pr_2Dy_2Al_2B_4$ | 430 | 16 | 5.0 | 2.5 |
| 37 | $Fe_{66}Co_6Nd_{12}Pr_2Dy_2Al_2B_4$ + 1.2% $ZrB_2$ | 430 | 20 | 6.3 | 4.2 |
| 38 | $Fe_{67}Co_{10}Dy_3Nd_{12}Si_1B_7$ | 400 | 17 | 6.0 | 3.0 |
| 39 | $Fe_{67}Co_{10}Dy_3Nd_{12}Si_1B_7$ + 1.2% $TiB_2$ | 400 | 20 | 7.5 | 4.0 |
| 40 | $Fe_{78}Nd_8Ce_2Tb_2Y_2B_8$ | 460 | 15 | 4.0 | 2.0 |
| 41 | $Fe_{78}Nd_8Ce_2Tb_2Y_2B_8$ + 1.2% $H_fB_2$ | 460 | 18 | 6.0 | 3.3 |

Having thus described the invention, what we claim and desire to obtain by Letters Patent of the United States is:

1. A method for preparing a fine grained iron-neodymium-boron bulk-shaped alloy comprising the steps of:

forming an alloy melt having the following composition: $Fe_aCo_bNd_cR_dN_eB_f$ wherein Fe, Co, Nd and B are iron, cobalt, neodymium and boron respectively, and R is an element selected from the group consisting of lanthanum, yttrium, cerium, dysprosium, terbium, gadolinium, and praseodymium and mixtures thereof, and N is an element selected from the group consisting of aluminum, silicon, germanium, niobium and gallium and mixtures thereof, wherein a=60–80, B=0–20, c=5–20, d=0–10, e=0–5 and f=3–10 respectively with the proviso that the sum (a+b+c+d+e+f)=100, adding 0.3 to 3 weight percent of at least one diboride selected from the group consisting of hafnium diboride, zirconium diboride tantalum diboride and titanium diboride, to said melt of alloy, depositing said melt against a rapidly moving quench surface adapted to quench said melt at a rate in the range of approximately between $10^{5°}$ to $10^{7°}$ C./second and form a rapidly solidified filament, ribbon or particulate of said alloys characterized predominantly by a single amorphous structure, comminuting said ribbon, filament or particulate into a powder, said powder having an average particle size of less than 60 mesh and consisting of platelets having a thickness of less than 0.1 millimeter, each platelet being defined by an irregularly shaped outline resulting from fracture, heat treating said powder by annealing the powder above the crystallization temperature in a vacuum or inert gas atmosphere, comminuting said heat treated powder under the vacuum or inert atmosphere to provide an ultrafine crystalline powder having an average size of 5 microns or less, subjecting said ultrafine crystalline powder to cold compaction under an applied magnetic field so that a majority of the crystalline powder becomes oriented so as to allow a large fraction of magnetic domains to be aligned parallel to the direction of the applied magnetic field, and sintering the magnetically aligned powder into a bulk shape.

2. The method as defined in claim 1 wherein the bulk-shaped alloy has the formula $$Fe_{Balance}Co_{0-20}$$

$$Nd_{12-16}Al_{0-3}Dy_{0-3}B_{7-10}$$

and contains 1 to 2 weight percent of at least one diboride selected from the group consisting of hafnium diboride, zirconium diboride, tantalum diboride and titanium diboride.

* * * * *